US005250496A

United States Patent [19]

Warner et al.

[11] Patent Number: 5,250,496

[45] Date of Patent: Oct. 5, 1993

[54] RECEIVING ELEMENT WITH CELLULOSE PAPER SUPPORT FOR USE IN THERMAL DYE TRANSFER

[75] Inventors: Cheryl L. Warner, Brockport; Douglas G. Wimer, Rochester, both of N.Y.

[73] Assignee: Eastman Kodak Company, Rochester, N.Y.

[21] Appl. No.: 822,522

[22] Filed: Jan. 17, 1992

[51] Int. Cl.[5] ..... B41M 5/035; B41M 5/38

[52] U.S. Cl. ..... 503/227; 428/195; 428/211; 428/318.4; 428/513; 428/537.5; 428/913; 428/914

[58] Field of Search ..... 8/471; 428/195, 211, 428/513, 537.5, 318.4; 503/227

[56] References Cited

U.S. PATENT DOCUMENTS 4,774,224 9/1988 Campbell ..... 503/227
4,778,782 10/1988 Ito et al. ..... 503/227
4,994,147 2/1991 Foley et al. ..... 162/137

FOREIGN PATENT DOCUMENTS 0415455 3/1991 European Pat. Off. ..... 430/486
03-010889 1/1991 Japan ..... 503/227

*Primary Examiner*—B. Hamilton Hess
*Attorney, Agent, or Firm*—Andrew J. Anderson

[57] ABSTRACT

Dye-receiving elements for thermal dye transfer are disclosed comprising a cellulose fiber paper support having thereon a dye image-receiving layer. The cellulose fibers of the paper support are fibers of hardwood varieties selected from those a) having a length weighted average fiber length equal to or less than about 0.5 mm as measured after pulping and bleaching or b) pulped by the sulfite process. The paper supports have a specific bending stiffness of less than about 0.4 $Nm^7/kg^3$ for paper prepared on a continuous Fourdrinier wire machine as measured in the machine direction.

14 Claims, No Drawings

RECEIVING ELEMENT WITH CELLULOSE PAPER SUPPORT FOR USE IN THERMAL DYE TRANSFER

Reference is made to co-pending, concurrently filed commonly assigned U.S. Ser. No. 07/822,523 of Campbell et al., the disclosure of which is incorporated by reference.

This invention relates to dye-receiving elements used in thermal dye transfer, and more particularly to receiving elements having cellulosic paper supports.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed faceto-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4,1986, the disclosure of which is hereby incorporated by reference.

In a thermal dye transfer printing process, it is desirable for the finished prints to compare favorably with color photographic prints in terms of image quality. Dye-receiving elements used in thermal dye transfer generally comprise a polymeric dye imagereceiving layer coated on a base or support. The base has a major impact on image quality. Image uniformity is dependent on the conformability of the receiver base. The look of the final print is largely dependent on the base's whiteness and surface texture. Receiver curl before and after printing is desirably minimized. Cellulose paper, synthetic paper, and plastic films have all been proposed for use as dye-receiving element supports in efforts to meet these requirements.

U.S. Pat. No. 4,774,224 discloses using a resin coated paper with a surface roughness measurement of 7.5 Ra microinches-AA or less. This type of paper is generally used for photographic bases, and consequently, it has the photographic look. This base has excellent curl properties both before and after printing, and due to its simple design is relatively inexpensive to manufacture. However, most commercial thermal printers are now being built with low printing pressures to make them more cost-effective. Since this base is not very conformable under printing conditions with low pressure between a print head and a printer drum, it does not yield high uniformity prints.

U.S. Pat. No. 4,778,782 discloses laminating synthetic paper to a core material, such as natural cellulose paper, to form a receiver base, and describes how synthetic paper used alone as a receiver base suffers from curl after printing. Synthetic papers are disclosed in, for example, U.S. Pat. No. 3,841,943 and U.S. Pat. No. 3,783,088, and may be obtained by stretching an orientable polymer containing an incompatible organic or inorganic filler material. By this stretching, bonds between the orientable polymer and fillers in the synthetic paper are destroyed, whereby microvoids are considered to be formed. These bases provide good uniformity and efficiency. The laminated structures do improve curl properties, but still do not meet all curl requirements. Although effective, such materials are complex in structure, thick, and thus are relatively costly to manufacture.

For thermal dye transfer receivers it is always desirable to have transferred dye images with le minimum mottle. Mottle-index values (as measured on an instrument such as a Tobias Mottle Tester) are used as a means to measure print uniformity, especially the type of nonuniformity called dropouts which manifests itself as numerous small unprinted areas. Mottle is conveniently minimized by using heat-resistant smooth surfaced polymeric film supports such as polyesters, however, these do not have the feel and handling properties such as are associated with photographic prints which customarily use a paper stock. When paper stock is used for thermal dye-transfer prints there are problems to a greater or lesser degree with mottle.

While generally regarded as desirable, increasing the smoothness of a paper surface itself does not solve all problems. Smooth surface papers are not only costly, but to make papers with high surface smoothness, it is necessary to refine the paper fibers to a high degree to obtain good formation. This refining also causes the sheet strength to increase. It is known that the pulping process is a factor in fiber strength, for example, the kraft process produces inherently strong fibers, whereas the sulfite process produces weaker fibers. An increase in fiber strength results in a higher intrinsic sheet stiffness and less conformance to the thermal head. This in turn creates costly engineering design problems and/or requires higher head pressures for the printing equipment. Increased refining of paper fibers thus produces opposing properties and can not easily be optimized to obtain improved image uniformity.

There is a need to develop a recciver base which can fulfill all of these requirements. That is, a base that is planar both before and after printing, yields an image of high uniformity and dye density, has a photographic look and is inexpensive to manufacture. It is thus an object of this invention is to provide a base for a thermal dye-transfer receiver which exhibits low curl and good uniformity and provides for efficient dye-transfer.

These and other objects are accomplished in accordance with the invention, which comprises a dye-receiving element for thermal dye transfer comprising a cellulose fiber paper support having thereon a dye image-receiving layer, wherein the paper support has a specific bending stiffness (as described in the "Handbook of Physical and Mechanical Testing of Paper and Paperboard," Vol. 1, R. E. Mark, ed., 1983) of less than 0.4 $Nm^7/kg^3$ for paper prepared on a continuous Fourdrinier wire machine as measured in the machine direction. Paper supports made from cellulose fibers of hardwood varieties selected from those a) having a length weighted average fiber length equal to or less than about 0.5 mm as measured after pulping and bleaching or b) pulped by the sulfite process have been found to possess the desired bending stiffness.

By proper pulp fiber choice, it is possible to create a paper stock which has low intrinsic stiffness and therefore the necessary conformance to the thermal head. These fibers are of the hardwood variety. They need to be either very short (i.e., equal or less than 0.5 mm length weighted average fiber length after pulping and bleaching as measured, e.g., on a Kajaani Automation Inc. FS-100 Fiber Length Analyzer), or pulped in such a way (such as the sulfite process) as to be very weak. Consequently they can be refined to produce a sheet of good surface quality and of the necessary low intrinsic stiffness which will produce a thermal dye-transfer receiver for imaging with low mottle. In a preferred embodiment, the paper support comprises at least 50% hardwood fibers having a length weighted average fiber length equal to or less than about 0.5 mm as measured after pulping and bleaching.

These papers are preferably formed at 0.05 to 0.25 mm (more preferably 0.10 to 0.20 mm) in thickness and may be furnished with additives as is described in the art (see U.S. Pat. No. 4,994,147 and EP 0 415 455). These additives include wet end starches (at 0 to 3%), poly(amino)amide epichlorohydrin wet strength resins (at 0 to 1%), alkyl ketene dimers at 0 to 0.75%, inorganic fillers (at 0 to 20%), aluminum chloride, aluminum sulfate, polyaluminum chloride or aluminum hydroxychlorides (at 0 to 4%), rosin or fatty acid sizes (at 0 to 4%), and optical brightening agents (at 0 to 1%).

These paper may be extrusion coated on the receiver layer side with polyolefins such as polyethylene or polypropylene which may optionally contain white pigments such as titanium dioxide or zinc oxide. Alternatively, these papers may be laminated with oriented microvoided packaging films or synthetic papers such as are described in copending U.S. Ser. No. 07/822,523 of Campbell et al. and U.S. Pat. No. 4,778,782, the disclosures of which are incorporated by reference. The laminations can be carried out as an extrusion lamination using polyolefins or by a variety of adhesives such as are used in the art.

The back-side of the paper supports (i.e., the side opposite to the receiver layer) may also similarly be coated or laminated with a polymeric layer, packaging film, and/or synthetic paper, and may also further include a backing layer such as those disclosed in U.S. Pat. No.5,011,814 of Harrison and U.S. Pat. No. 5,096,825 of Martin, the disclosures of which are incorporated by reference.

The dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye imagereceiving layer may be present in any amount which is effective for the intended purpose. In general, good results have been obtained at a concentration of from about 1 to about 10 $g/m^2$. An overcoat layer may be further coated over the dye-receiving layer, such as described in U.S. Pat. No. 4,775,657 of Harrison et al., the disclosure of which is incorporated by reference.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described e.g., in U.S. Pat. Nos. 4,916,112, 4,927,803 and 5,023,228, the disclosures of which are incorporated by reference.

As noted above, dye-donor elements are used to form a dye transfer image. Such a process comprises imagewise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal o printing head. After the first dye is transferred, the elements are peeled apart. A second dye-donor element (or another area of the donor element with a different dye area) is then brought in register with the dyereceiving element and the process repeated. The third color is obtained in the same manner.

The following examples are provided to further illustrate the invention.

EXAMPLE 1

Paper stocks were produced for the receiver elements from the indicated fibers or fiber blends on a production scale fourdrinier paper machine and had a furnish that included the following chemicals based on dry fiber weight: alkyl ketene dimer (0.15%), cationic starch (1.0%), polyaminoamide epichlorhydrin (0.2%), polyacrylamide resin (0.1%), diaminostilbene optical brightener (0.14%) and sodium bicarbonate (1%). The papers were surface sized by treatment with a solution of hydroxyethylated starch and sodium chloride. The chemical addenda and surface sizing are well-know techniques in the paper art and are not considered critical to the practice of the invention. The following paper stocks were produced:

A1) A paper made from a 1:1 blend of Pontiac Maple 51 (a bleached maple hardwood kraft of 0.5 mm length weighted average fiber length) (Consolidated Pontiac, Inc.) and Alpha Hardwood Sulfite (a bleached red-alder hardwood sulfite of 0.69 mm average fiber length)

(Weyerhaeuser Paper Co.) formed at 0.17 mm thickness and 0.18 kg/m$^2$ basis weight.

A2) As A1 but formed at 0.14 mm thickness and 0.16 kg/m$^2$ basis weight.

A3) As A1 but formed at 0.13 mm thickness and 0.15 kg/m$^2$ basis weight.

A4) A paper made from Pontiac Maple 51 fibers only formed at 0.15 mm thickness and 0.17 kg/m$^2$ basis weight.

A5) As A4 but formed at 0.12 mm thickness and 0.15 kg/m$^2$ basis weight.

The produced paper stocks were each extruded on the receiver side with pigmented polypropylenepolyethylene (80:20 wt. ratio) containing anatase titanium dioxide (approximately 6 weight %) and zinc oxide (1.5 weight %) at a total coverage of 22 g/m$^2$. The back side of each stock was extruded with unpigmented polyethylene at 22 g/m$^2$ and had a gelatin based antistat-anticurl coating commonly used in the photographic art.

Thermal dye transfer receiver elements were prepared by coating the following layers in order on the pigmented polyolefin layer coated paper stock supports:

a) Subbing layer of Z-6020 (an aminoalkylene aminotrimethoxysilane) (Dow Corning Co.) (0.10 g/m$^2$) from ethanol.

b) Dye receiving layer of Makrolon 5700 (a bisphenol-A polycarbonate) (Bayer AG) (1.6 g/m$^2$), a co-polycarbonate of bisphenol-A and diethylene glycol (1.6 g/m$^2$), diphenyl phthalate (0.32 g/m$^2$), di-n-butyl phthalate (0.32 g/m$^2$), and Fluorad FC-431 (fluorinated dispersant) (3M Corp.) (0.011 g/m$^2$) from dichloromethane.

c) Dye receiver overcoat layer of a linear condensation polymer considered derived from carbonic acid, bisphenol-A and diethylene glycol (50:50 mole ratio) (0.22 g/m$^2$), 510 Silicone Fluid (Dow Corning Co.) (0.16 g/m2), and Fluorad FC-431 (0.032 g/m$^2$) from dichloromethane.

Control receivers were produced with paper stocks C1 and C2:

C1) A paper made from a 1:1 blend of Pontiac Hardwood PF81 (a bleached predominantly birch, maple and poplar kraft of 0.7 mm length weighted average fiber length) (Consolidated Pontiac, Inc.) and Tempure 95 (a bleached predominantly spruce and balsam softwood sulfite of 1.6 mm length weighted average fiber length) (Tembec Inc.) formed at 0.19 mm thickness and 0.19 kg/m$^2$ basis weight. This stock is not unlike that used for commercial photographic papers. The same extruded polyolefin layers and (a) subbing layer, (b) dye-receiving layer, and (c) dye-receiver overcoat were coated to form the control receiver as described above for the invention receivers.

C2) A paper made from a 3:1 blend of Bleached Eucalyptus Kraft Pulp (a bleached eucalyptus hardwood kraft of 0.7 mm length weighted average fiber length) (Aracruz Cellulose, S.A.) and Pontiac Maple 51 (a bleached hardwood maple kraft of 0.5 mm length weighted average fiber length) formed at 0.16 mm thickness and 0.17 kg/m$^2$ basis weight. The same extruded polyolefin layers, (b) dye-receiving layer, and (c) dye-receiver overcoat were coated to form the control receiver as described above for the invention receivers. A subbing layer of 0.07 g/m$^2$ poly(acrylonitrile-co-vinylidene chloride-coacrylic acid) (15:78:7 wt. ratio) was coated from methylethylketone in place of subbing layer (a).

A paper stock used on a commercial sample of a thermal dye-transfer receiver was evaluated as a comparison:

C3) A paper stock isolated from Fujix Video Graphic Paper VP-H100 (Fujix Photo Film KK). This thermal print paper consists of a polyester receiving layer, and polyolefin layer coated on a 0.16 mm thick paper stock. The dye-receiver polymer layer was removed by xylene treatment as described below. Physical properties suggest the paper stock consists of red alder hardwood sulfite fibers, mixed hardwood kraft fibers (primarily maple, birch and poplar), and mixed softwood fibers (primarily spruce and balsam species) approximately equal or greater than 0.6 mm length weighted average fiber length. Because this was a commercial sample, the fiber length had to be measured after being processed into paper and redispersed as a slurry which would effectively shorten average fiber length.

Fiber lengths of all pulps except the commercial sample C3 were evaluated using an FS-100 Fiber Length Analyzer (Kajaani Automation Inc.).

For the purposes of evaluation of basis weight and stiffness on an equivalent basis, each complete receiver with extruded polyolefin layer, subbing layer, dye-receiving layer, and dye-receiver overcoat layer was subjected to a solvent treatment to remove all coated layers from the paper stock itself. The dye receiver was treated with agitation for one minute in a tray of xylene heated between 32° and 38° C. This process was repeated using a second portion, after which the paper sample was air dried on paper toweling and conditioned to 50% RH, 22° C.

The basis weight of each paper was determined by weighting a 38 cm ×70 cm area of each solvent treated and conditioned paper stock. Basis weight (kg/m$^2$) and thickness (mm) then determine density (kg/m$^3$). Thickness was determined by a TMI Caliper Gauge (Texting Machines, Inc.).

The inherent sheet strength of the paper stock was measured by determining the bending stiffness ($S_b$) and then calcuating the specific bending stiffness ($S_b$*) as described in the "Handbook of Physical and Mechanical Testing of Paper and Paperboard Vol 1", R. E. Mark, ed. 1983. The force required to bend a 38 mm ×70 mm area of paper stock (the same sample as used for basis weight) through a 15 degree angle (0.262 radians) over a span of 20 mm was determined using the SCAN-p29 method using a L and W 10-1 Stiffness Tester (Lorentzen and Wettre Co.) and using the following relationship:

$$S_b=[60(F)(l^2)]/[\theta\pi]$$

where:

$S_b$ = bending stiffness (Newton meters, Nm)

F = measured bending force (Nm/mm)

$\theta$ = angle (15°)

$\pi$ = 3.141592654 l = span (20 mm)

To compare stiffness for materials of different basis weights, specific bending stiffness ($S_b$*), is calculated:

$$S_b^*=(S_b)/W^3$$

where:

$S_b$* specific bending stiffness (Nm$^7$/kg$^3$)

W = basis weight (kg/m$^2$)

Magenta dye containing thermal dye transfer donor elements were prepared by coating on 6 μm poly(ethylene terephthalate) support:

a) a subbing layer of Tyzor TBT (a titanium tetra-n-butoxide) (duPont Co.) (0.12 g/m$^2$) from 1-butanol.

b) a dye-layer containing the magenta dyes illustrated below (0.12 and 0.13 g/m$^2$) and S-363 (Shamrock Technologies, Inc.) (a micronized blend of polyolefin and oxidized polyolefin particles) (0.016 g/m$^2$), in a cellulose acetate propionate binder (2.5% acetyl, 45% propionyl) (0.40 g/m$^2$) from a toluene, methanol, and cyclopentanone solvent mixture.

On the backside of the dye donor element was coated:

a) a subbing layer of Tyzor TBT (a titanium tetra-n-butoxide) (duPont Co.) (0.12 g/m$^2$) from 1-butanol b) a slipping layer of Emralon 329 (a dry film lubricant of poly(tetrafluoroethylene) particles) (Acheson Colloids Co.) (0.59 g/m$^2$), BYK-320 (a polyoxyalkylene-methylalkyl siloxane copolymer) (BYK Chemie USA) (0.006 g/m$^2$), PS-513 (an aminopropyl dimethyl terminated poly dimethyl siloxane) (Petrarch Systems, Inc.) (0.006 g/m$^2$), and S-232 (a micronized blend of polyethylene and carnauba wax particles) (Shamrock Technologies, Inc.) (0.016 g/m$^2$) coated from a toluene, n-propyl acetate, 2-propanol and 1-butanol solvent mixture.

The magenta dye structures are:

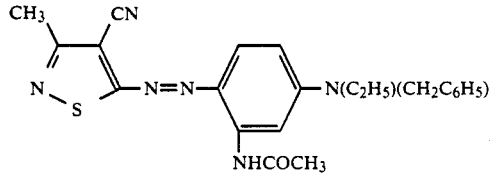

and

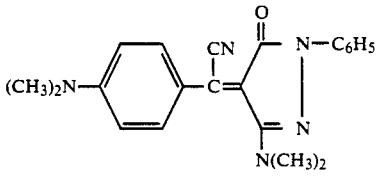

The dye side of the dye-donor element approximately 10 cm × 15 cm in area was placed in contact with the polymeric receiving layer side of the dye-receiver element of the same area. The assemblage was fastened to the top of a motor-driven 56 mm diameter rubber roller and a TDK Thermal Head L-231 (No. 6-2R16-1), thermostated at 26°C., was pressed with a force of 9 Newtons against the dye-donor element side of the assemblage pushing it against the rubber roller.

The imaging electronics were activated and the assemblage was drawn between the printing head and roller at 7 mm/sec. Coincidentally, the resistive elements in the thermal print head were pulsed at 128 μsec intervals (29 μsec/pulse) during the 33 msec/dot printing time. The voltage supplied to the print head was approximately 23.5v with a power of approximately 1.3 watts/dot and energy of 7.6 mjoules/dot to create a "mid-scale" test image of uniform density (0.2–0.5 density units) over an area of approximately 9 cm × 12 cm.

After printing the donor element was separated from the receiving element and the nonuniformity (mottle) of the magenta image was measured on a Tobias MT1 Mottle Tester (Tobias Associates, Inc.) at 64 readings/data point, 0.38 mm spacing, 186 data points/scan, 4.5 mm filter width, 20 scans/sample. Three replicates of each sample were printed and measured for uniformity. The average mottle index obtained is tabulated in Table I below for each different paper stock.

A mottle index of not greater than 350 is desired; receiver images stocks with a mottle index greater than 350 have been found by experience to be visually objectionable.

TABLE I

| Paper Stock | Bending Stiffness (Nm) | Specific Bending Stiffness (Nm$^7$/kg$^3$) | Mottle Index (Relative) |
|---|---|---|---|
| A1 | 0.0018 | 0.31 | 270 |
| A2 | .0013 | 0.32 | 270 |
| A3 | .0010 | 0.30 | 270 |
| A4 | .0016 | 0.33 | 280 |
| A5 | .0008 | 0.24 | 280 |
| C1 | .0029 | 0.42 | 390 |
| C2 | .0021 | 0.43 | >500 |
| C3 | .0024 | 0.49 | >500 |

The data above show that a specific bending stiffness as measured in the machine direction of less than 0.40 for paper stock made on a production scale fourdrinier paper machine will result in a thermal dyetransfer receiver with lessened mottle. Paper stock which produces a receiver of low mottle is characterized as derived from hardwood fibers either very short in length or pulped by a process, such as the sulfite process, that gives characteristically weak fibers.

EXAMPLE 2

This example is similar to Example 1 and uses paper stocks produced on a production scale fourdrinier paper machine but instead of single extruded polyolefin layer, a microvoided composite packaging film was extrusion laminated with unpigmented low density polyethylene to the paper stock. The polyethylene inner layer was present at 13 g/m$^2$. The backside of the paper stock was extruded with high density polyethylene (22 g/m$^2$).

The microvoided composite packaging film used was BICOR OPPalyte 300 HW (Mobil Chemical Co.) (38 μm thick) consisting of a microvoided and orientated polypropylene core (approximately 75% of the total film thickness) with a layer of non-microvoided orientated polypropylene on each side.

The following paper stock was produced:

A6) As A1 formed at 0.16 mm thickness and 0.18 kg/m$^2$ basis weight.

Thermal dye transfer receivers were prepared as described in Example 1 by coating the same three layers (a) subbing layer, (b) dye-receiving layer, and (c) dye-receiver overcoat layer, except the polymer for the overcoat layer was a linear condensation polymer considered derived from carbonic acid, bisphenol-A, diethylene glycol, and an aminopropyl terminated poly dimethylsiloxane (49:49:2 mole ratio) (0.22 g/m$^2$).

A paper stock was produced for a control receiver C4 (the same microvoided composite packaging film was extrusion laminated with unpigmented polyethylene to the paper stock and the same three layers (a) subbing layer, (b) dye-receiving layer, and (c) dye-receiver overcoat layer were coated as described above for the invention receivers), differing only in the composition of the paper stock.

C4) As C1 formed at 0.20 mm thickness and 0.19 kg/m$^2$ basis weight. This stock is not unlike that used for commercial photographic papers.

The same xylene solvent treatment was used prior to evaluation of the basis weight, bending stiffness, and specific bending stiffness for the invention and control as described in Example 1.

The same magenta dye-donor, printing procedure to produce a mid-scale magenta image and mottle evaluation were prepared and used as in Example 1. The results are presented in Table II.

TABLE II

| Paper Stock | Bending Stiffness (Nm) | Specific Bending Stiffness (Nm$^7$/kg$^3$) | Mottle Index (Relative) |
|---|---|---|---|
| A6 | 0.0015 | 0.26 | 200 |
| C4 | 0.0030 | 0.44 | 420 |

The above data show the lessened mottle obtained from the hardwood blend paper stock of the invention compared to the control consisting of the hardwood-softwood blend.

EXAMPLE 3

This example is similar to Example 1 but provides additional data on paper stocks produced in a laboratory sheet mold rather than a production scale fourdrinier paper machine. The wood pulp fibers were first refined in a valley beater as described in TAPPI T200 OM-85. Each fiber slurry was diluted to 1% based on the dry fiber, and the following chemicals based on the dry fiber weight were added: alkyl ketene dimer (0.15%), cationic corn starch (1.0%), poly (amino) amide epichlorhydrin resin (0.2%), and polyacrylamide resin (0.1%) diaminostilbene optical brightener (0.14%) and sodium carbonate (1%). Paper sheets were form at 3.4 g as described in TAPPI T205 OM-88 except that the pressed sheets were dried on a felted drum dryer at 95° C. All dried sheets were calendered to bring them to their final density.

Each sheet was fastened to a paper web and then overcoated with pigmented polyethylene containing anatase titanium dioxide (approximately 6 weight %) and zinc oxide (1.5 weight %) at a total coverage of 19 g/m$^2$. The backside of each sheet was also coated with 19 g/m$^2$ unpigmented polyethylene. These paper stocks with the polyolefin layers represented the thermal dye-transfer receivers.

The following paper stocks were produced:

A7) As A4 and formed at 0.15 mm thickness and 0.17 kg/m$^2$ basis weight.

A8) A paper made from Alpha Hardwood Sulfite (a bleached red alder hardwood sulfite of 0.7 mm length weighted average fiber length) (Weyerhauser Paper Co.) formed at 0.15 mm thickness and 0.19 kg/m$^2$ basis weight.

A9) As A1 and formed at 0.15 mm thickness and 0.18 kg/m$^2$ basis weight.

Paper stocks were produced on a laboratory sheet mold as described above as controls (the same extruded polyolefin layers were present on the front and back and as with the paper stocks of the invention; no dye-receiver layers as such were coated):

C5) A paper made from Pinacle Prime (a bleached primarily oak hardwood kraft of 0.8 mm length weighted average fiber length) (Westvaco Corp.) formed at 0.16 mm thickness and 0.19 kg/m$^2$ basis weight.

C6) A paper made from Port Hudson Hardwood (a bleached mixed oak, gum, elm, and ash hardwood kraft of 0.9 mm length weighted average fiber length (Georgia Pacific Co.) formed at 0.15 mm thickness and 0.19 kg/m$^2$ basis weight.

C7) A paper made from Leaf River 90 Bleached Hardwood (a bleached oak and gum mixture hardwood kraft of 0.9 mm length weighted average fiber length (Georgia Pacific Co.) formed at 0.16 mm thickness and 0.19 kg/m$^2$ basis weight.

C8) A paper made from Prince Albert Aspen Hardwood (a bleached aspen hardwood kraft of 0.7 mm length weighted average fiber length) formed at 0.15 mm thickness and 0.18 kg/m$^2$ basis weight.

C9) As C1 and formed at 0.16 mm and 0.19 kg/m$^2$ basis weight. This stock is not unlike that used for commercial photographic papers.

C10) A paper made from Kamloops Kraft (a bleached blend of British Columbian softwood kraft of 2.2 mm length weighted average fiber length) formed at 0.16 mm thickness and 0.19 kg/m$^2$ basis weight.

C11) A paper made from Columbus Pine (a bleached mixed southern yellow pine softwood kraft of 2.3 mm length weighted average fiber length) formed at 0.16 mm thickness and 0.20 kg/m$^2$ basis weight.

C12) A paper made from Leaf River 90 (a bleached loblolly pine softwood kraft of 2.4 mm length weighted average fiber length) formed at 0.16 mm thickness and 0.18 kg.m$^2$ basis weight.

Basis weight, bending stiffness and specific bending stiffness as described in Example 1 were measured on the hand sheets before polyolefin extrusion.

The same magenta dye-donor, printing procedure to produce a mid-scale magenta image, and mottle evaluation were prepared and used as in Example 1 except the printing was done directly on the pigmented polyethylene resin. The results are presented in Table III.

TABLE III

| Paper Stock | Bending Stiffness (Nm) | Specific Bending Stiffness (Nm$^7$/kg$^3$) | Mottle Index (Relative) |
|---|---|---|---|
| A7 | 0.0012 | 0.21 | 250 |
| A8 | 0.0012 | 0.17 | 320 |
| A9 | 0.0013 | 0.19 | 280 |
| C5 | 0.0016 | 0.23 | 410 |
| C6 | 0.0015 | 0.22 | 390 |
| C7 | 0.0017 | 0.25 | 370 |
| C8 | 0.0017 | 0.29 | 380 |
| C9 | 0.0017 | 0.25 | 360 |
| C10 | 0.0021 | 0.31 | >500 |
| C11 | 0.0022 | 0.28 | 470 |
| C12 | 0.0017 | 0.29 | >500 |

The data above show that the A7 hardwood kraft short fibered paper (approximately 0.5 mm in length), A8 hardwood sulfite paper, or A9 hardwood kraft and hardwood sulfite blend paper when used as the paper stock for a thermal dye transfer receiver all gave less mottle than any of the comparisons using a hardwood kraft of longer fiber length (approximately 0.7 mm or greater) C5 to C8, or the softwood kraft comparisons C10 to C12. The paper C9, resembling commercial photographic paper stock composed of a hardwood kraft of long fiber length and a softwood kraft was also unsatisfactory.

In Example 1 and 2 it was indicated that a specific bending stiffness of less 0.4 was desirable. The specific bending stiffness for these hand sheets is not directly comparable to papers made on a production machine due to lack of fiber orientation and lack of directionality of drying restraint. In this instance a specific bending stiffness of less than 0.22 appears desirable (for example $S_b$* of 0.21 for A9 compares to $S_b$* of 0.31 for A1 and $S_b$* of 0.24 for C9 compares to $S_b$* of 0.41 for C1) for paper stocks produced in a laboratory sheet mold rather than a production scale fourdrinier paper machine.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a cellulose fiber paper support having thereon a dye image-receiving layer, the improvement wherein the paper support has a specific bending stiffness of less than or equal to about 0.33 $Nm^7/kg^3$ for paper prepared on a continuous Fourdrinier wire machine as measured in the machine direction.

2. The element of claim 1, further comprising a polyolefin layer coated between the paper support and the dye image-receiving layer.

3. The element of claim 2, wherein the polyolefin layer is pigmented.

4. The element of claim 1, further comprising a microvoided polymeric layer between the paper support and the dye image-receiving layer.

5. The element of claim 1, wherein the paper support has a thickness of from 0.05 to 0.25 mm.

6. The element of claim 1, wherein the cellulose fibers of the paper support are fibers of hardwood varieties selected from those a) having a length weighted average fiber length equal to or less than about 0.5 mm as measured after pulping and bleaching or b) pulped by the sulfite process.

7. The element of claim 6, wherein the cellulose fibers of the paper support comprise at least 50% hardwood fibers having a length weighted average fiber length equal to or less than about 0.5 mm as measured after pulping and bleaching.

8. The element of claim 7, wherein the cellulose fibers of the paper support consist essentially of hardwood fibers having a length weighted average fiber length equal to or less than about 0.5 mm as measured after pulping and bleaching.

9. In a process of forming a dye transfer image comprising:

a) imagewise-heating a dye-donor element comprising a support having thereon a dye layer comprising a dye dispersed in a binder, and b) transferring a dye image to a dye-receiving element comprising a cellulose fiber paper support having thereon a dye image-receiving layer to form said dye transfer image, the improvement wherein the cellulose fibers of the paper support are fibers of hardwood varieties selected from those a) having a length weighted average fiber length equal to or less than about 0.5 mm as measured after pulping and bleaching or b) pulped by the sulfite process, the paper support having a specific bending stiffness of less than or equal to about 0.33 $Nm^7/kg^3$ for paper prepared on a continuous Fourdrinier wire machine as measured in the machine direction.

10. The process of claim 9, wherein the cellulose fibers of the paper support comprise at least 50% hardwood fibers having a length weighted average fiber length equal to or less than about 0.5 mm as measured after pulping and bleaching.

11. The process of claim 10, wherein the cellulose fibers of the paper support consist essentially of hardwood fibers having a length weighted average fiber length equal to or less than about 0.5 mm as measured after pulping and bleaching.

12. In a thermal dye transfer assemblage comprising:

a) a dye-donor element comprising a support having thereon a dye layer comprising a dye dispersed in a binder, and b) a dye-receiving element comprising a cellulose fiber paper support having thereon a dye imagereceiving layer, said dye-receiving element being in a superposed relationship with said dye-donor element so that said dye layer is in contact with said dye image-receiving layer, the improvement wherein the cellulose fibers of the paper support are fibers of hardwood varieties selected from those a) having a length weighted average fiber length equal to or less than about 0.5 mm as measured after pulping and bleaching or b) pulped by the sulfite process, the paper support having a specific bending stiffness of less than or equal to about 0.33 $Nm^7/kg^3$ for paper prepared on a continuous Fourdrinier wire machine as measured in the machine direction.

13. The assemblage of claim 12, wherein the cellulose fibers of the paper support comprise at least 50% hardwood fibers having a length weighted average fiber length equal to or less than about 0.5 mm as measured after pulping and bleaching.

14. The assemblage of claim 13, wherein the cellulose fibers of the paper support consist essentially of hardwood fibers having a length weighted average fiber length equal to or less than about 0.5 mm as measured after pulping and bleaching.

* * * * *